US005102171A

United States Patent [19]

Saetre

[11] Patent Number: 5,102,171

[45] Date of Patent: Apr. 7, 1992

[54] STATIC CLING GREETING CARD

[76] Inventor: Robert S. Saetre, 354 South Hamen, Palatine, Ill. 60010

[21] Appl. No.: 480,109

[22] Filed: Feb. 14, 1990

[51] Int. Cl.[5] ..... B42D 15/00

[52] U.S. Cl. ..... 283/117; 446/149

[58] Field of Search ..... 283/117; 446/147, 149

[56] References Cited

U.S. PATENT DOCUMENTS 4,652,239 3/1976 Brimberg .

FOREIGN PATENT DOCUMENTS 0189817 8/1986 European Pat. Off. ..... 283/117

2122544 1/1984 United Kingdom ..... 283/117

OTHER PUBLICATIONS

"Stik-ees" Catalog.

"Carrousel" Window & Mirror Decorations ("Snoopy").

*Primary Examiner*—Timothy V. Eley

*Assistant Examiner*—Willaim Fridie, Jr.

*Attorney, Agent, or Firm*—Willian Brinks Olds Hofer Gilson & Lione

[57] ABSTRACT

A greeting card is constructed of at least one or two panels of a sheet-form material having at least a portion of one surface of at least one of the panels being substantially smooth and non-porous. All surfaces of the panels are printable. A thin sheet of static cling vinyl overlies and is electrostatically adhered to the material's smooth non-porous surface. The sheet of static cling vinyl is adapted to be manually peeled from the flexible material and electro-statically selectively adhered any number of times to any other smooth, non-porous surface to display printing on the sheet or to decorate the other surface.

11 Claims, 2 Drawing Sheets

STATIC CLING GREETING CARD

FIELD OF THE INVENTION

This invention relates generally to a multi-part greeting card.

BACKGROUND OF THE INVENTION

The present invention has particular application to apparatus and methods for employing a multi-part greeting card with decorative figures.

Multi-part greeting cards are well known. Decorative figures that may be peeled from a sheet and electrostatically adhered to any smooth non-porous surface without the use of glues or adhesives are known.

For instance, U.S. Pat. No. 4,652,239 discloses a space planning system that employs a sheet of static cling vinyl. Portions of the vinyl sheet may be peeled from a storage surface and placed on a work surface for use in preparing floor plans and furniture arrangements.

Other products provide for flat sheets of static cling vinyl that contain figures and designs that may be affixed to glossy surfaces.

However, these prior products do not provide for a multi-part greeting card which employs a sheet of static cling vinyl with design figures that is only electrostatically adhered to a surface of the greeting card. Rather, these products provide only a means for packaging and storing a sheet of static cling vinyl. None of these prior art products provides a multi-purpose product of a greeting card containing a separable design that may be only electrostatically adhered to various surfaces.

SUMMARY OF THE INVENTION

The present invention discloses a greeting card, in particular, a multi-part greeting card that provides a reusable non-adhesive design figure that may be applied to any smooth non-porous surface.

More specifically, the greeting card of this invention comprises a sheet-form material that has a plurality of panels with at least a portion of a surface of one of the panels being substantially smooth and non-porous. The card has an overlying sheet of static cling vinyl material that is electrostatically adhered to the smooth, non-porous surface of the sheet-form material. This sheet of static cling vinyl may be manually peeled from the non-porous surface and electrostatically adhered to any other smooth, non-porous surface. The sheet may be repeatedly applied to and removed from various smooth, non-porous surfaces. The sheet of static cling vinyl preferably has an imprinted design with a first and second surface, either of which may be electrostatically adhered to a smooth, non-porous surface without the use of tapes, glues or any form of adhesives.

In one embodiment, the sheet of static cling vinyl is imprinted with a design or a plurality of designs that are die-cut about the periphery of the design, such that the design may be easily peeled from the sheet-form surface and removed from the portion of the vinyl sheet that remains electrostatically adhered to the sheet-form material.

The invention, together with its attendant advantages, will be further understood by reference to the following detailed description taken in conjunction with the accompanying drawings, in which:

BRIEF DESCRIPTION OF THE DRAWINGS

FIGS. 7 and 8 are illustrative examples of surfaces the design figures of the present invention may be electrostatically adhered to.

DETAILED DESCRIPTION OF EMBODIMENTS OF THE INVENTION

The multi-part greeting card 10 is constructed of a sheet-form material formed of a plurality of panels and a thin sheet of static cling vinyl 18. The sheet of static cling vinyl 18 is only electrostatically adhered to at least a surface of a panel of the sheet-form material. The surface of the panel that the sheet of static cling vinyl is electrostatically adhered to has a smooth, non-porous texture 16.

Figure 1:
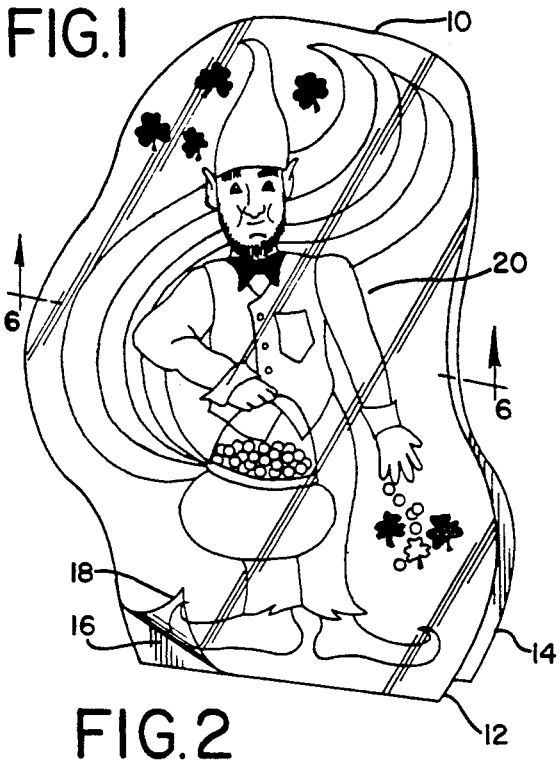
FIG. 1 is a perspective view of a greeting card made in accordance with the present invention.

An embodiment of the present invention, as shown in FIG. 1, illustrates a greeting card 10 of sheet-form material consisting of a pair of panels, a front panel 12 and rear panel 14 attached together by means of adhesive, along a glue line 22. The sheet-form material is also foldable. Each panel of the sheet-form material of FIG. 1 has a first and a second surface. At least a portion of one of these surfaces has a smooth non-porous texture 16. The thin vinyl sheet 18 is adhered only electrostatically to the smooth non-porous surface.

The vinyl sheet is an imprinted design figure 20 that may be manually peeled from the smooth non-porous surface of the sheet-form material and electrostatically adhered to various other surfaces. The design FIG. 20 may be a greeting or imprinted design. The design FIG. 20 may be imprinted by silk screening, lithography, offset printing or any other suitable printing means. The design FIG. 20 may be repeatedly applied to various smooth non-porous surfaces or reapplied to the smooth non-porous surface of the sheet-form material. The design figure may be stored in plastic bags or on the sheet-form material.

Figure 2:
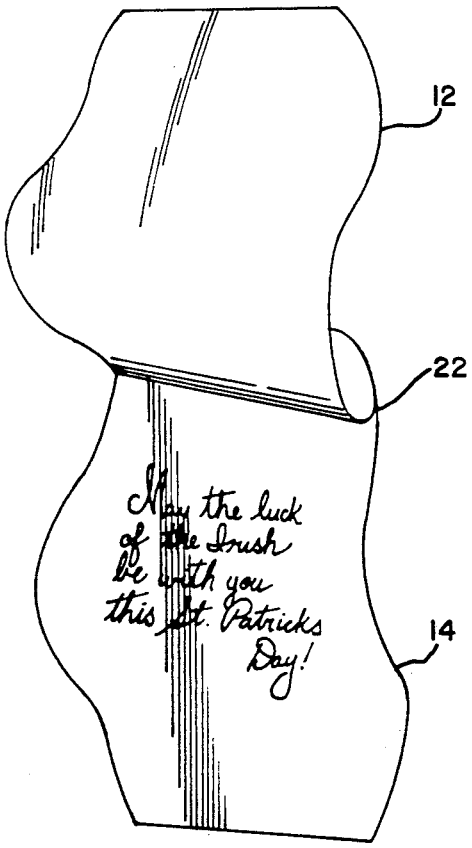
FIG. 2 is a perspective view of the inner panel surfaces of a greeting card made in accordance with the present invention.
Figure 4:
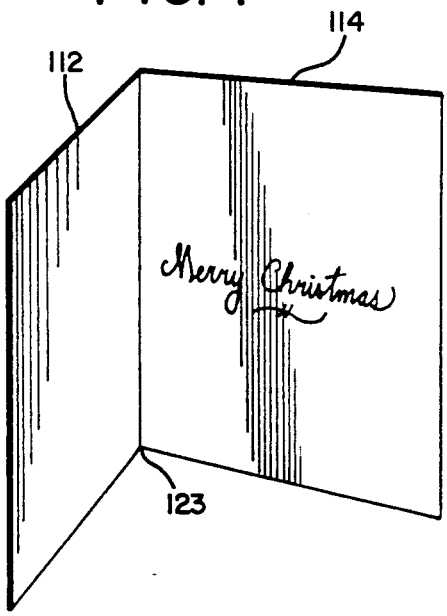
FIG. 4 is a perspective view of the inner panel surface of one embodiment of a greeting card made in accordance with the present invention.
Figure 5:
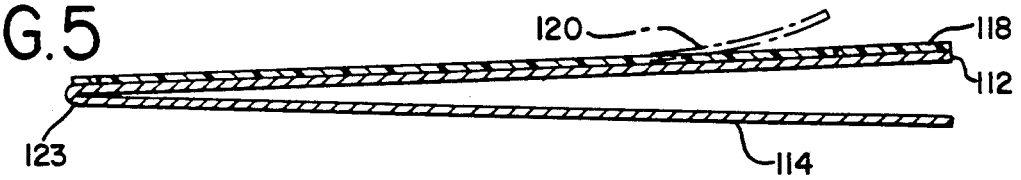
FIG. 5 is a cross-sectional view of the greeting card of FIG. 3 taken along line 5—5 of FIG. 3.

The panel surfaces of the sheet-form material are printable as shown in FIGS. 2 and 4. The vinyl sheet may be electrostatically adhered to a smooth non-porous surface of either the front panel 12 or the rear panel 14 of the sheet-form material.

Figure 6:
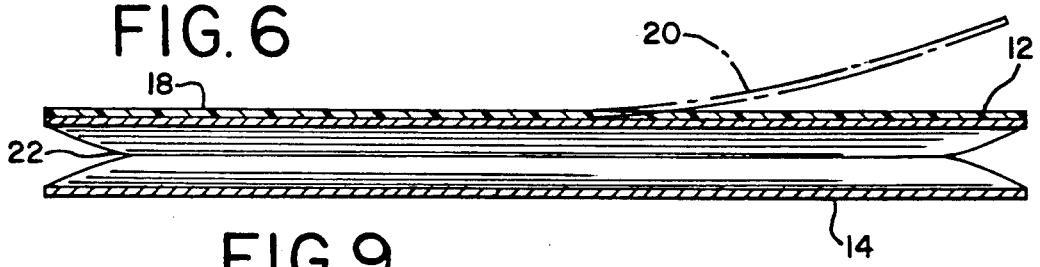
FIG. 6 is a cross-sectional view of the greeting card of FIG. 1 taken along line 6—6 of FIG. 1.

As shown in FIG. 6, the thin vinyl sheet overlies a surface of the sheet-form material of the greeting card and is adhered only electrostatically to that surface of the sheet-form material. The vinyl sheet is adapted to be manually peeled from the sheet-form material. The vinyl sheet 18 is preferably formed of a polyvinyl chloride material and may be manufactured by a known process, as well known in the art.

Figure 3:
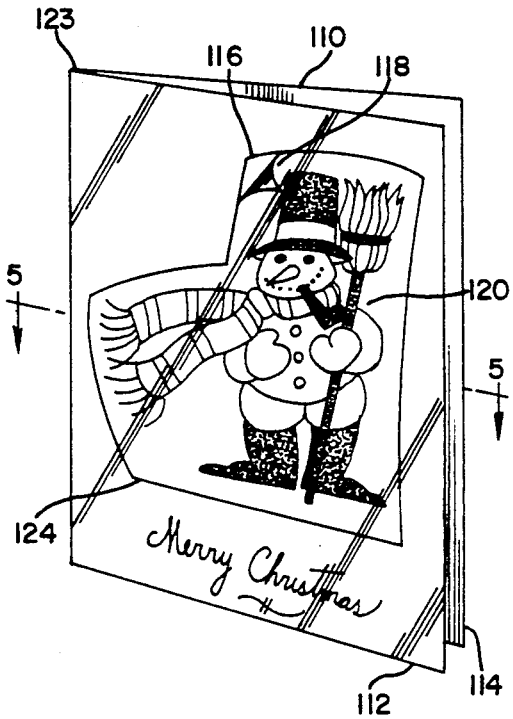
FIG. 3 is a perspective view of another embodiment of a greeting card made in accordance with the present invention.
Figure 7:
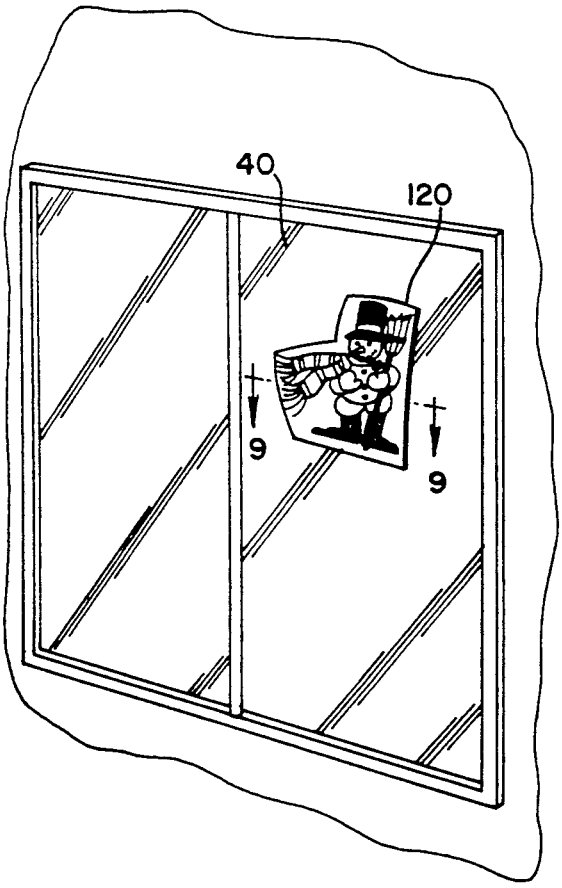
Figure 8:
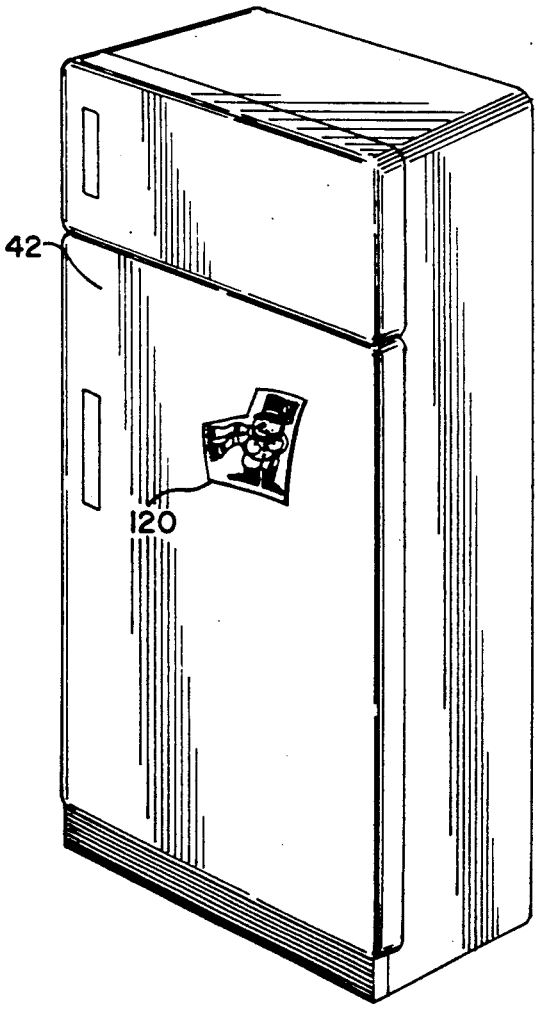

A second embodiment of the greeting card is shown in FIG. 3. In this embodiment the vinyl sheet 118 is imprinted with a design figure 120 that is die-cut on a line 124 about the periphery of the design figure, within the larger rectangular border of the greeting card itself. The die-cut 124 allows for the design figure 120 to be manually peeled from the die-cut area without removing the entire sheet of static cling vinyl from the sheet-form material. The die-cut design figure 120 may be electrostatically adhered to various smooth surfaces in the same manner as described previously, and as shown in FIGS. 7 and 8. FIG. 7 illustrates by example only the design figure 120 electrostatically adhered to a glass window pane 40. FIG. 8 illustrates by example only the design figure electrostatically adhered to the surface of a refrigerator door 42. The design figure 120 shown in FIGS. 7 and 8 is adhered to the surfaces without the use of tape, glues, or adhesive materials. In this embodiment a plurality of die-cut design figures may be formed from the vinyl sheet; thereby providing a single greeting card with more than one design figure electrostatically adhered thereto. The front panel 112 and rear panel 114 of this embodiment are attached by means of a fold line 123 formed in the sheet-form material.

A third embodiment of the greeting card is illustrated by the front panel 112 of FIG. 3. In this embodiment the multi-part greeting card 110 consists of a single panel 112 having two surfaces. A design figure is electrostatically adhered to at least a portion of one of the surfaces of the single panel. All surfaces of the panel are printable. In this embodiment, a greeting is printed on the panel surface on which the thin sheet of static cling vinyl is electrostatically adhered. Thereby, after removal of the design figure this embodiment serves as a flat greeting card. In this embodiment the design figure may consist of the entire sheet of static cling vinyl as shown in FIG. 1 or may be a design figure that is die-cut about the periphery of the design as shown in FIG. 3.

Figure 9:
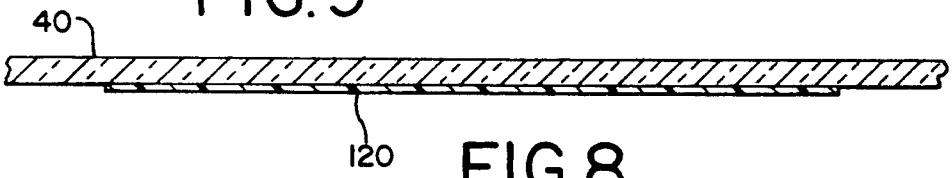
FIG. 9 is a cross-sectional view of a design figure of the present invention taken along line 9—9 of FIG. 7.

As shown in FIG. 9, the design figure 120 is adhered only electrostatically to the surface of a window pane 40. The greeting card of this invention does not require the use of tapes, glues, or adhesives to adhere the design figure to various smooth surfaces. On some surfaces dampening the surface or the design figure may aid in electrostatically adhering the design figure to the desired appropriate surface, such as a refrigerator surface 42 shown in FIG. 8. In addition, after several uses the design figures may be cleaned in water to revive their adherence capabilities.

Thus, while the invention has been described in connection with reference to specific exemplary embodiments, it will be apparent to those skilled in the art that various changes and modifications to the structure, arrangement, portions, elements, materials and components used in the practice of this invention are possible without departing from the principals of this invention.

What is claimed is:

1. A greeting card comprising:

a sheet-form material having a plurality of panels, the panels forming a front surface of said card and a second surface, said sheet-form material having at least a portion of one of said front and second surfaces that is substantially smooth and non-porus and at least the other of said front and second surfaces bearing printed indicia thereon, and a thin sheet of static cling vinyl material, said vinyl material at least partially overlying said smooth non-porus surface of said sheet-form material, being electrostatically, removably and reattachably adhered thereto, and at least a portion thereof being adapted to be manually peeled therefrom and electrostatically, removably and reattachably adhered to any other smooth non-porus surface.

2. The greeting card defined in claim 1, wherein said sheet of static cling vinyl is formed of polyvinyl chloride.

3. The greeting card defined in claim 1, wherein said sheet of static cling vinyl is die-cut, about a periphery of a design or figure printed thereon.

4. The greeting card defined in claim 1, wherein the sheet-form material includes a fold line formed between at least two of said panels.

5. The greeting card defined in claim 1, wherein each surface of the said panels of said sheet-form material is adapted to be printed upon.

6. A greeting card comprising:

a sheet-form material having at least a pair of panels with at least a portion of one of said panels having a substantially smooth and non-porus surface and the other of said panels having a greeting indicia printed thereon, and a thin sheet of static-cling vinyl material overlying and electrostatically adhered to said smooth non-porus surface of said sheet-form material and adapted to be manually peeled therefrom and removably and reattachably electrostatically adhered onto any selected, smooth, non-porus surface.

7. The greeting card defined in claim 6, wherein said sheet-form material is foldable and includes a fold formed between said panels

8. The greeting card defined in claim 6, wherein said panels of said sheet-form material are attached by an adhesive means.

9. The greeting card defined in claim 6, wherein said static cling vinyl is formed of polyvinyl chloride.

10. The greeting card defined in claim 6, wherein said vinyl sheet is an imprinted design, said design electrostatically adhered to said sheet-form material and adapted to be manually peeled therefrom and electrostatically adhered to any other smooth non-porous surface.

11. The greeting card of claim 6, wherein said sheet of static cling vinyl is die-cut, about a periphery of a design or figure printed thereon.

* * * * *